United States Patent [19]

Zavodny

[11] 4,034,670

[45] July 12, 1977

[54] DAMPENING DEVICE FOR LITHOGRAPHIC PRINTING PRESS

[75] Inventor: Eugene N. Zavodny, Riverside, Ill.

[73] Assignee: Rockwell International Corporation, Pittsburgh, Pa.

[21] Appl. No.: 561,600

[22] Filed: Mar. 24, 1975

[51] Int. Cl.[2] ..... B41F 7/30

[52] U.S. Cl. ..... 101/148; 101/364

[58] Field of Search ..... 101/147, 148, 350, 363, 101/364, 367, 141; 239/219–221

[56] References Cited

U.S. PATENT DOCUMENTS

| | | | |
|---|---|---|---|
| 2,266,869 | 12/1941 | Kimball et al. | 239/220 |
| 2,291,046 | 7/1942 | Lange | 239/220 |
| 2,868,118 | 1/1959 | Dahlgren | 101/147 |
| 2,876,039 | 3/1959 | Vogdt | 101/363 |
| 2,995,084 | 8/1961 | Mosegaard | 101/147 |
| 3,008,407 | 11/1961 | Roberts et al. | 101/148 |
| 3,106,154 | 10/1963 | Saul | 101/147 |
| 3,259,062 | 7/1966 | Dahlgren | 101/451 |
| 3,433,155 | 3/1969 | Norton | 101/148 |
| 3,545,379 | 12/1970 | Norton | 101/148 |
| 3,651,758 | 3/1972 | Harrod | 101/148 |
| 3,690,254 | 9/1972 | Krochert | 101/350 |
| 3,759,175 | 9/1973 | Alsop | 101/148 |
| 3,873,025 | 3/1975 | Qvarnstrom | 239/220 |

FOREIGN PATENT DOCUMENTS

| | | | |
|---|---|---|---|
| 1,547,793 | 11/1967 | France | 101/147 |

*Primary Examiner*—Edgar S. Burr
*Assistant Examiner*—William Pieprz

[57] ABSTRACT

A spray-type dampening apparatus for lighographic printing presses comprises a resilient surfaced, fluid supply roller that is partially immersed in a reservoir of dampening fluid and a coacting, hard surfaced feed roller having generally longitudinally disposed grooves in the peripheral surface thereof and forming a nip with the supply roller. The supply roller is rotated at a surface speed sufficient to advance and maintain a supply of dampening fluid from the reservoir to the said nip whereas the feed roller is rotated at a high surface speed relative to the supply roller to thereby generate and project a fine mist of the dampening fluid from the nip toward an adjacent transfer roller.

9 Claims, 3 Drawing Figures

DAMPENING DEVICE FOR LITHOGRAPHIC PRINTING PRESS

BACKGROUND OF THE INVENTION

A definite need has long existed for an efficient, economical apparatus to dampen the printing plates on lithographic printing presses and particularly rotary, lithographic newspaper presses. Such apparatus preferably should avoid contact between the dampening fluid supply elements and any ink carrying surface to thereby preclude or at least minimize the contamination with ink of the supply elements and/or the fluid in the dampening system.

Various types of dampening mechanisms have been used in the past on rotary newspaper presses, but without complete success. Continuous duty type dampeners that are used widely on commercial presses, for example, have proved to be unsatisfactory on newspaper presses. This is due primarily to their inability to consistently supply sufficient water to the plate in order to compensate for the loss thereof due to the absorptive nature of newsprint stock and the normal high running speed of such presses.

Brush type dampeners also have failed to satisfy the requirements. These devices are subject to contamination, premature wear, inconsistency in the amount of water transferred and they tend to project or spray relatively large droplets which are clearly discernable as water spots in the printed products. Other known types of spray dampeners also have failed to gain commercial acceptance for various reasons such as the large droplet size, their inability to provide uniform coverage, lack of efficient lateral controls and/or clogging due to the additives required in the dampening solution.

SUMMARY OF THE INVENTION

This invention overcomes the deficiencies of the prior devices and provides means for generating a fine mist uniformly across the entire width of the plate cylinder. The volume and particle size of the generated mist can be varied and controlled to suit specific requirements and effective means are provided for achieving selective lateral control.

The mist generating apparatus essentially consists of a supply roller and a coacting feed roller, both of which are mounted for rotation about respective parallel axes and in a manner that their respective surfaces are in physical contact at a mist generating nip.

The supply roller is provided with a smooth, continuous, resilient surface of rubber or the like material and it is adapted to be partially immersed in a reservoir of dampening fluid. The feed roller, in turn, has a hard surface, preferably metallic, which is naturally water receptive or which may be treated so as to be water receptive and it is provided with a plurality of generally longitudinally disposed flutes or grooves at equally spaced intervals about the circumference thereof.

The supply roller is rotated at a relatively low surface speed so as to advance and maintain a continuous supply of fluid at the entrance side of the mist generating nip whereas the feed roller is driven at a high surface speed whereby the grooves thereon sequentially separate a minute bead of fluid from the supply at the entrance to the nip, convey the bead through the nip and then, due to centrifugal force, fling the fluid toward the plate cylinder or an adjacent transfer roller in the form of a fine mist. The supply and feed rollers preferably are fully enclosed by a housing having a longitudinal slot therein adjacent the exit side of the mist generating nip and baffle means are provided for selectively adjusting the area of said slot for lateral control.

DESCRIPTION OF THE INVENTION

Figure 1:
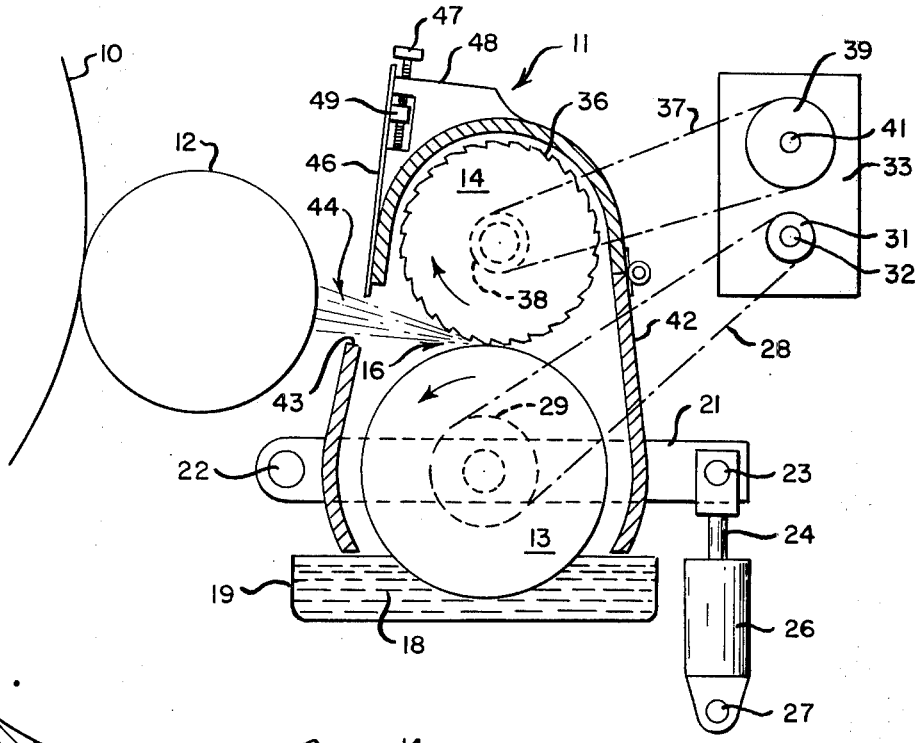
FIG. 1 is a simplified, side elevational view, partly in section, illustrating a preferred embodiment of the invention.

Referring now to the drawings the invention is illustrated as embodied in a conventional lithographic printing press having a plate cylinder 10 which carries a conventional lithographic printing plate about its circumference. The image areas of the plate are adapted to receive ink from the usual train of inking rollers, not shown, whereas the non-image portions of the plate are adapted to receive ink repelling dampening fluid from a dampening mechanism 11. In normal operation, the lithographic plate is moistened by the dampening device 11 during each revolution of the plate cylinder prior to receiving ink from the ink form rollers.

In FIG. 1 the dampening mechanism is shown as including a form dampening or transfer roller 12 which is located so as to receive the dampening fluid from the mist generating portion of the dampener mechanism, to be described, and then deposit it directly on the printing plate. This is for illustrative purposes only, however, and it shall be understood that the mist may be projected directly onto the plate or onto a roller of the inking system or any one of a series of rollers in a separate dampening roller train. Therefore, the term "transfer" roller as used herein is intended to cover any roller which serves to convey the dampening fluid either directly or indirectly to the printing plate.

Turning now to the mist generating portion of the dampening device, it will be seen that it consists essentially of a supply roller 13 and a coacting mist generating or feed roller 14, each of which is mounted for rotation about an axis parallel to the axis of the plate cylinder 10 and in a manner that they form a mist generating nip at 16. The supply roller preferably consists of a metal core having a covering of rubber or composition material 17 thereon which provides a smooth, continuous, resilient surface that is coextensive with the plate cylinder 10 and which is adapted to be partially immersed in a reservoir of dampening fluid 18 contained in a pan or fountain 19. To provide for movement of the supply roller 13 relative to the feed roller 14, it is journalled for rotation at each end thereof in a lever 21, one end of which is pivotally supported at 22 on a side frame member, not shown. At the opposite end thereof the lever 21 is pivotally connected at 23 to the piston rod 24 of an air cylinder 26 which, in turn, is secured at 27 to the side frame. The respective air cylinders 26 are each connected to a common source of air pressure, not shown, and, therefore, when activated, they will bias the supply roller 13 against the feed roller 14 with a force that is precisely equal and uniform throughout the entire length of the rollers. The supply roller 13 is arranged to be driven in a counterclockwise direction, as indicated by the arrow in FIG. 1, by means of a belt 28 which is tracked about a pulley 29 on the roller shaft and a second pulley 31 on the output shaft 32 of a variable speed drive unit 33.

The feed roller 14 is journalled for rotation about a fixed axis for coaction with the supply roller 13 and it is constructed from a hard material, preferably metal which is normally water receptive or which may be treated in the conventional manner so as to render the peripheral surface thereof hydrophilic or water receptive. The feed roller is precisely coextensive with the supply roller and it is provided about the peripheral surface thereof with a multiplicity of equi-spaced, generally longitudinally disposed flutes or grooves 36 which, as will be explained more fully hereinafter, function in conjunction with the supply roller 13 to create and project a fine mist of dampening fluid from the nip 16 to the surface of the transfer roller 12. The variable speed drive unit 33 also drives the feed roller 14 at the required speed in a clockwise direction, as viewed in FIG. 1, through a belt 37 that is tracked about a pulley 38 on the roller shaft and a pulley 39 on a second output shaft 41 of the unit.

A housing 42 substantially completely encloses the supply and feed rollers, not only to confine the mist to the immediate vicinity of the rollers, but also to prevent contamination of the dampening mechanism from ink spray, paper lint and the like. A longitudinal slot 43, which extends the full length of the supply and feed rollers, is provided along one side of the housing 42, intermediate the nip 16 and the roller 12, to permit the generated mist, indicated at 44, to impinge upon the surface of the roller 12 from whence it is transferred to the plate cylinder 10. In order to control the volume of fluid which reaches the transfer roller 12 and particularly to provide lateral control of the volume in accordance with the requirements of the lithographic plate, a series of adjustable baffles 46 are provided on the housing 42. The number and width of the baffles can be varied and will depend upon the fineness of the control desired, but each baffle is mounted for adjustment on the housing 42 by means such as a screw 47. The screw 47 is fixed against axial movement in a bracket 48 and is threaded through a tapped hole in a boss 49 on each baffle. Thus the individual baffles can be raised or lowered to thereby vary the supply of dampening fluid in local areas across the width of the plate.

Figure 3:
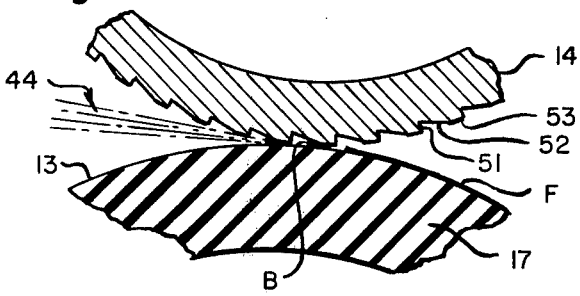
FIG. 3 is an enlarged fragmentary sectional view at the nip formed between the supply and feed rollers.
Figure 2:
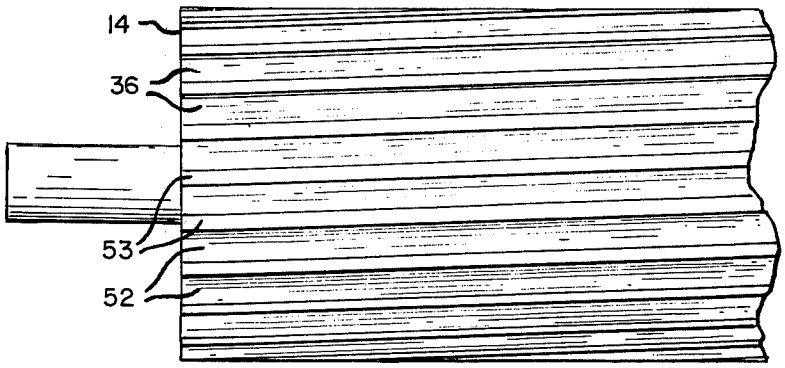
FIG. 2 is an enlarged plan view of a portion of the grooved feed roller.

With further reference to the feed roller 14 and the illustrations in FIGS. 2 and 3, it has been determined that the size, spacing and configuration of the grooves 36 are important factors in the efficient operation of the dampening device. The grooves are preferably formed with a front wall 51, considering the direction of rotation of the roller, which is radially disposed or, in other words, substantially normal to the peripheral surface of the roller and have a depth of about 0.010 inch. The other wall 52 of the groove is essentially a segment of a chord which extends from the base of the radial wall 51 to a point at which it intersects the peripheral surface of the roller which point is spaced from the radial wall of the next adjacent groove thereby leaving a small area 53 of the roller surface between adjacent grooves. In a preferred embodiment, the spacing between the radial walls 51 should be approximately 3/16 inch and the circumferential length of the surface area 53 between the grooves should be approximately 1/16 inch.

The grooves also may extend lengthwise of the roller precisely parallel to the roller axis. In actual practice, however, it was found that when the roller was rotated at the surface speeds necessary to produce the required fine mist, such longitudinal grooves tended to generate a high intensity, high pitched, objectionable noise. By generating the grooves at a helix angle of about 10°, as indicated in FIG. 2, the noise was eliminated and no adverse effect upon the mist generating function was noted.

For optimum results, the supply roller 13 is biased against the feed roller 14 by means of the air cylinders 26 under a pressure of between one to 2 pounds per lineal inch and it is driven at surface speeds within the range of 150 to 250 feet per minute. The feed roller, on the other hand, is preferably driven at surface speeds ranging between 1500 and 3000 feet per minute.

Except at a very light loading, where the output increases, variations in the nip pressure between the rollers have little or no affect on the mist generating function, higher pressures merely resulting in excessive loads on the drive. Variability of the roller speeds is necessary and desirable, however, to control the volume and character of the mist. By varying the surface speed of the supply roller 13, for example, the overall volume of the output can be increased or decreased to suit specific requirements. In this respect, however, the practical speed range lies between 150 and 250 feet per minute. At speeds much below 150 feet per minute, the output drops below the minimum permissible limits. At speeds in excess of 250 feet per minute, the nip tends to become overflooded, the droplets become somewhat enlarged and the fluid will be sprayed out of the reservoir 19.

The principal effect of variations in feed roller speed is to control the fineness of the mist. At surface speeds near the low end of the speed range, i.e. 1500 feet per minute, the droplets are larger and they become finer as the speed is increased. At speeds much below 1500 feet per minute the droplets become too large and a graininess or water spots will become evident in the printed products. At speeds substantially in excess of 3000 feet per minute, the particles become too fine, resulting in non-uniform distribution across the width of the printing plate and which is probably due to aerodynamic effects.

Although adjustment of the respective roller speeds can be used while the press is in operation to control the volume output and the quality or particle size of the mist, this method of control is not preferred. On the contrary, more uniform and consistent results are achieved if the optimum speeds of the rollers are established to provide the maximum output and particle size for the average jobs to be printed, after which they can remain constant. Thereafter, control of the moisture on the plate is maintained by means of the adjustable baffles which are easy to control and are conveniently available to the pressman.

The ability of this device to generate a very fine, uniform mist is believed to be due primarily to the configuration and function of the grooves 36. With further reference to FIG. 3, it will be apparent that when the mechanism is in operation the supply roller 13 will convey a continuous supply of dampening fluid on its surface in the form of a thin film F from the reservoir 19 to the nip 16. Depending upon the surface speeds of the rollers, a small bead of fluid may be formed at the entrance side of the nip and which will extend the full length of the rollers.

At this point, due to the pressure between the rollers and the substantially higher speed of the feed roller, each succeeding groove 36 functions to separate from the film F a metered amount of fluid in the form of a small, longitudinally extending bead B. The bead B will remain substantially intact as the groove 36 advances into and through the nip 16 with the surface area 53 forming a dam as it wipes over the resilient surface of the supply roller 13. Upon emerging from the nip, however, the pressure between the surface 53 and the supply roller is progressively relieved whereupon the bead B travels to the sharp edge formed by the surface 53 and the next adjacent groove wall 51 at which point it is released as a fine mist under the influence of centrifugal force.

The bead B does not, however, roll over the surface 53 as an integral unit which would result in its being released in the form of relatively large droplets. On the contrary, the surface 53 is instrumental in converting the bead B into a thin, migrating film which is then sequentially released as a fine mist.

As was previously stated the surface of the feed roller 14 is water receptive, but as each portion 53 passes through the nip 16 it is wiped relatively dry by the coacting resilient surface of the supply roller. Consequently, as the surface 53 emerges from the nip, the bead B of fluid does not roll intact to the sharp edge of the next groove. Instead the bead B tends to spread into a thin film over the wiped, water receptive surface 53 and then migrates progressively toward the edge of the next adjacent groove. As a result it is sequentially released for a finite period in the form of a fine mist and before all of the fluid is released from one edge, mist from the next succeeding edge is commencing to be released. A continuous spray or mist is thus formed without intervening gaps which might affect the uniformity of the distribution on the printing plate.

It will also be evident from the illustration in FIG. 3 how, by varying the surface speed of the supply roller 13, more or less fluid will be presented to the nip 16 in a given period of time and thus the volume projected per groove 36 will be varied. Moreover, by varying the speed of the feed roller, smaller or larger beads B will be separated from the advancing film F whereby the particle size of the mist can be varied to suit specific requirements.

While we have herein disclosed a preferred embodiment of the invention, modifications and changes will become apparent to anyone skilled in the art. For example, it will be readily apparent that variable speed gear drive means can be substituted for the belt means shown. Means other than air cylinders can readily be used to bias the supply roller against the feed roller and the baffles 46 can obviously be adjusted by means other than the screws 47. It is intended, therefore, that all such modifications which do not depart from the spirit and scope of the invention shall come within the scope of the appended claims.

I claim:

1. A dampening mechanism for the plate cylinder of a rotary lithographic printing press comprising, a reservoir of dampening fluid, a supply roller having a smooth, continuous, resilient surface mounted for rotation about an axis parallel to the plate cylinder axis and with a portion of its surface immersed in said dampening fluid, a feed roller of rigid material mounted for rotation about an axis parallel to said supply roller and having its surface in pressure contact with said supply roller at a nip spaced from said reservoir, a plurality of circumferentially spaced, generally longitudinal grooves formed in the surface of said feed roller for sequentially advancing metered amounts of dampening fluid through said nip as the supply roller and the feed roller rotate, drive means for rotating said supply roller at a surface speed sufficient to convey a film of dampening fluid on its surface from said reservoir and to maintain a supply thereof at the said nip, and drive means for rotating said feed roller in an opposite direction with respect to and at a surface speed substantially greater than said supply roller whereby, upon passing through said nip, the longitudinal grooves sequentially advance metered amounts of dampening fluid through said nip and progressively spray said fluid toward the plate cylinder in the form of a substantially continuous, fine mist.

2. A dampening mechanism as set forth in claim 1 wherein the longitudinal grooves on the feed roller are generated at a small helix angle.

3. A dampening mechanism as set forth in claim 1 wherein the drive means for said supply roller is adjustable whereby to vary the surface speed of the supply roller and thereby the volume of fluid sprayed.

4. A dampening mechanism as set forth in claim 1 wherein the drive means for said feed roller is adjustable whereby to vary the surface speed of said feed roller and thereby control the particle size of the sprayed mist.

5. A dampening mechanism as set forth in claim 1 wherein said feed roller is constructed of a hard material having water receptive characteristics.

6. A dampening mechanism as set forth in claim 1, further including means mounting said supply roller for movement toward and away from said feed roller, and actuating means connected to said mounting means for biasing said supply roller against said feed roller under a predetermined pressure.

7. A dampening mechanism as set forth in claim 1 further including fluid transfer roller means mounted for rotation adjacent the said nip between the supply and feed rollers to receive the sprayed mist and advance it toward the plate cylinder.

8. A dampening mechanism as set forth in claim 1 further including a housing substantially completely enclosing said supply and feed rollers, a longitudinal slot formed in said housing adjacent the said nip and coextensive with said rollers, a series of baffles adjustably mounted on said housing adjacent said slot, and means for selectively adjusting said baffles to vary the size of said slot at local areas along the length of said rollers.

9. A dampening mechanism as set forth in claim 1 wherein said longitudinal grooves are formed by a radially disposed front wall and an inclined rear wall that extends from the base of the front wall and intersects the peripheral surface of the feed roller at a point spaced a predetermined distance in advance of the front wall of the next adjacent groove.

* * * * *